US007657981B2

(12) United States Patent
Parker

(10) Patent No.: US 7,657,981 B2
(45) Date of Patent: Feb. 9, 2010

(54) CASKET WITH COMBINATION SHELF, DRAWER, AND/OR ALCOVE MEMORIALIZATION FEATURE

(75) Inventor: Daniel J. Parker, Connersville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 12/122,109

(22) Filed: May 16, 2008

(65) Prior Publication Data

US 2009/0282657 A1 Nov. 19, 2009

(51) Int. Cl.
*A61G 17/00* (2006.01)

(52) U.S. Cl. ..... 27/19; 27/14

(58) Field of Classification Search ..... 27/2, 27/14, 16, 19; D99/1, 2, 8, 10; 220/521–522; 190/5

See application file for complete search history.

(56) References Cited

U.S. PATENT DOCUMENTS 74,783 A * 2/1868 Wunderlich ..... 190/3
4,457,054 A 7/1984 Craft et al.
5,611,124 A 3/1997 Biondo et al.
6,324,736 B1 * 12/2001 Atrio ..... 27/2
6,715,190 B2 4/2004 Groemminger et al.
6,836,936 B1 * 1/2005 Biondo et al. ..... 27/2
6,898,830 B1 * 5/2005 Acton et al. ..... 27/2
7,159,287 B2 * 1/2007 Parker et al. ..... 27/19
7,249,402 B2 * 7/2007 Davis et al. ..... 27/18

* cited by examiner

*Primary Examiner*—William L. Miller
(74) *Attorney, Agent, or Firm*—Wood, Herron & Evans, LLP

(57) ABSTRACT

A casket comprises a shell, a cap closable on the shell, and a dish assembly mounted to an underside of the cap. The dish assembly comprises a cap panel, and either a) an alcove structure formed in the cap panel and adapted to receive an ornament for display when the cap is open, a shelf mounted to the cap panel which projects forwardly and is adapted to support an ornament for display when the cap is open, and a drawer assembly mounted to the cap panel for display and storage of items of memorialization of a deceased, or b) an alcove structure and a shelf, or c) an alcove structure and a drawer assembly, or d) a shelf and a drawer assembly.

34 Claims, 4 Drawing Sheets

CASKET WITH COMBINATION SHELF, DRAWER, AND/OR ALCOVE MEMORIALIZATION FEATURE

FIELD

This invention relates generally to caskets, and more particularly to memorialization features for caskets.

BACKGROUND

There is a trend in the death care industry towards "personalization"13 the personalizing of funeral products and funeral, memorial or other services purchased for the deceased, to provide a more meaningful experience for the family and friends of the deceased. Oftentimes, there is a desire on the part of the deceased's family and loved ones to memorialize the faithfully departed. This may manifest itself in several ways such as, for example, displaying various religious or sentimental items close to or on the casket during viewing of the deceased or even placing items in the casket prior to interment of the casket above or below ground. The display and/or storage of various items of personalty near or in caskets has existed as a means to memorialize the deceased.

One of the earlier attempts at providing a means of personalizing or customizing a casket to the deceased may be seen with reference to the assignee's U.S. Pat. No. 4,457,054 titled Casket Shelf. This patent discloses a casket shelf which is mounted to the dish assembly of the head end cap when the head end cap is in the open position, such as during viewing of the deceased. The shelf provides a surface for supporting and displaying articles of religious or personal significance to the deceased.

A more recent innovation may be seen with reference to the assignee's U.S. Pat. No. 5,611,124 titled Casket Having Memorabilia Compartment. Caskets embodying one embodiment of the invention of the '124 patent have a drawer built into the foot end lid in which keepsakes of the deceased can be stored and displayed, and are commercially available as the MemorySafe® line of caskets from Batesville®. Until the innovative casket of the '124 patent, caskets did not have any designated, easily accessible receptacle or compartment for either the display of personal effects of the deceased therein or the inclusion therein of mementos of memorialization by the deceased's family and friends. Prior attempts at solving this shortcoming had generally taken the form of the placement of a small memento box into the casket alongside the deceased. However, such memento boxes often appeared as an afterthought, simply placed alongside the deceased in the casket somewhat haphazardly. The '124 patent solved this shortcoming, as it provided the first casket with a memorabilia compartment integral to the casket for displaying and storing mementos and other items of memorabilia.

A further, and even more recent, innovation in the area of casket personalization may be seen with reference to the assignee's U.S. Pat. No. 6,715,190 for Memorialization Casket. This patent discloses an alcove structure formed in the cap panel in the underside of the head end lid, for receiving ornaments or memorabilia when the lid is in the open position during visitation or during a funeral or other memorial service, as a means of memorializing the deceased.

Despite the advancements made in the area of personalization of caskets as demonstrated by the products discussed above, there remains room for improvement.

SUMMARY

In one aspect a casket comprises a shell, a cap closable on the shell, and a dish assembly mounted to an underside of the cap, the dish assembly comprising a cap panel, an alcove structure formed in the cap panel and adapted to receive an ornament for display when the cap is open, a shelf mounted to the cap panel which projects forwardly and is adapted to support an ornament for display when the cap is open, and a drawer assembly mounted to the cap panel for display and storage of items of memorialization of a deceased.

In another aspect, a casket comprises a shell, a cap closable on the shell, and a dish assembly mounted to an underside of the cap, the dish assembly comprising a cap panel, an alcove structure formed in the cap panel and adapted to receive an ornament for display when the cap is open, and a shelf mounted to the cap panel which projects forwardly and is adapted to support an ornament for display when the cap is open.

In yet another aspect, a casket comprises a shell, a cap closable on the shell, and a dish assembly mounted to an underside of the cap, the dish assembly comprising a cap panel, an alcove structure formed in the cap panel and adapted to receive an ornament for display when the cap is open, and a drawer assembly mounted to the cap panel for display and storage of items of memorialization of a deceased.

In still another aspect, a casket comprises a shell, a cap closable on the shell, and a dish assembly mounted to an underside of the cap, the dish assembly comprising a cap panel, a shelf mounted to the cap panel which projects forwardly and is adapted to support an ornament for display when the cap is open, and a drawer assembly mounted to the cap panel for display and storage of items of memorialization of a deceased.

In a further aspect, a casket comprises a shell, a cap closable on the shell, and a dish assembly mounted to an underside of the cap, the dish assembly comprising a cap panel, and a drawer assembly mounted to the cap panel portion for display and storage of items of memorialization of a deceased.

The casket can be a full-couch casket having a single full length cap, or a split cap casket having a head end cap and a foot end cap. The alcove can have a floor, a pair of side walls, and a back wall. The shelf can be co-planar with the floor of the alcove. The alcove defines an opening in the cap panel, and the shelf can be wider than the opening. An upper end of the opening can be arcuately shaped. The shelf can have forwardly projecting corners which are arcuately shaped. The drawer assembly can comprise a drawer supporting box structure mounted to the cap panel and a drawer which is movably received in the box structure. The shelf can be wider than the box structure. The shelf can have forwardly projecting corners which are arcuately shaped, and the drawer can have a drawer front having forwardly projecting corners which are matingly arcuately shaped.

DRAWINGS

DESCRIPTION

Figure 1:
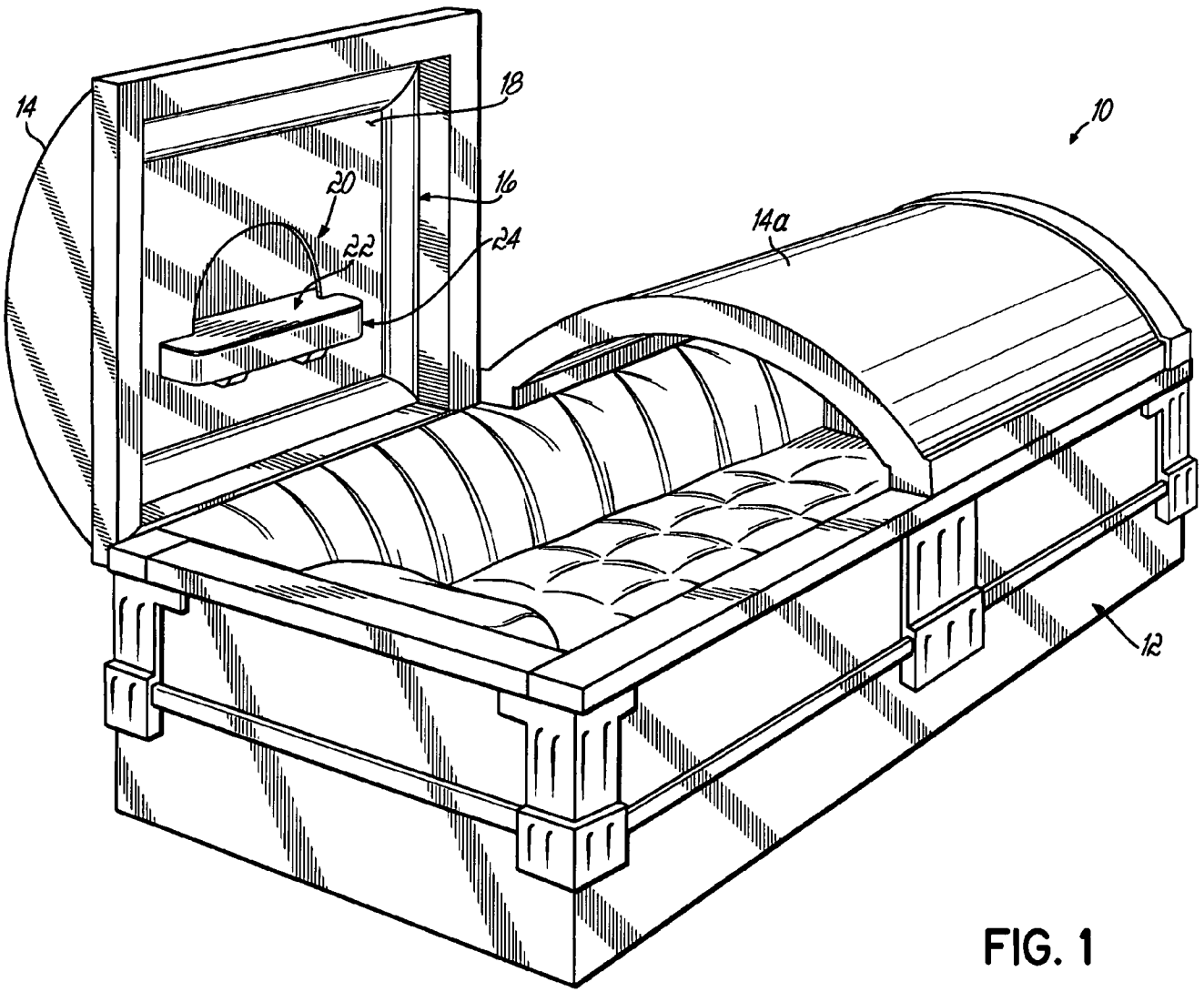
FIG. 1 is a perspective view of a casket with memorialization features according to the disclosure herein.
Figure 3:
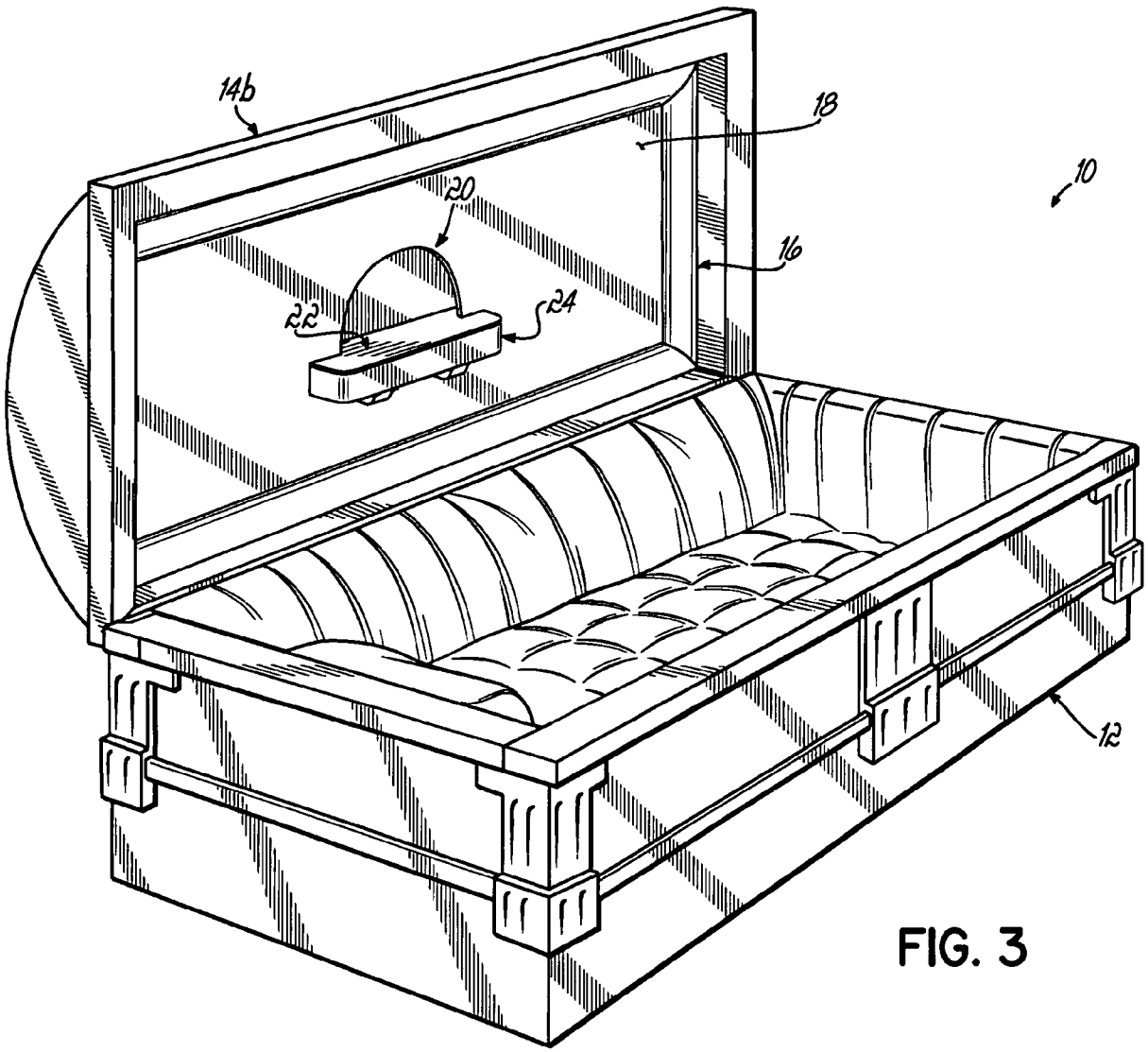
FIG. 3 is a view similar to FIG. 1 but with the memorialization feature in a full couch casket.

Referring to FIG. 1, a casket 10 has a shell 12, a cap or lid 14 which closes on the shell 12, and a dish assembly 16 mounted to an underside of the cap 14. As illustrated, casket 10 is a so-called split cap or half cap casket, and thus has the prior mentioned cap 14 at the head end of the casket 10 as well as a foot end cap 14*a*. The casket 10 could just as well have a single full-length cap 14*b*, in which case the casket 10 would be of the so-called full couch variety. See FIG. 3. Both types of caskets are deemed to be embraced by the claims.

The dish assembly 16 has a cap panel 18, and can have any combination of two of an alcove structure 20 formed in the cap panel 18 for receiving an ornament for display, a shelf assembly 22 mounted to the cap panel 18 for supporting an ornament for display, and a drawer assembly 24 mounted to the cap panel 18 for display and storage of items of memorialization of a deceased, or all three of the alcove 20, shelf 22, and drawer 24.

Figure 2A:
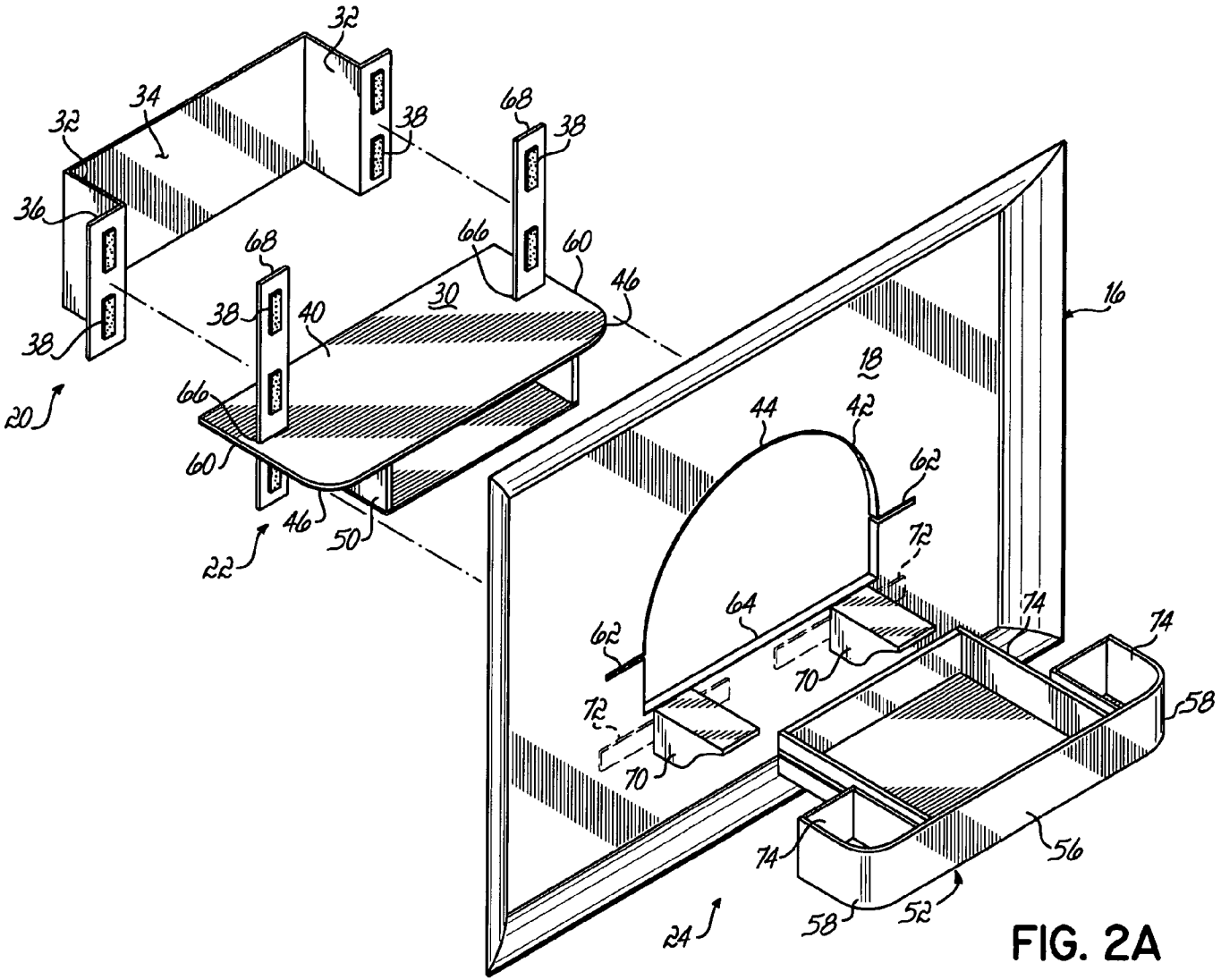
FIG. 2A is an exploded perspective view of the memorialization feature of FIG. 1.
Figure 2B:
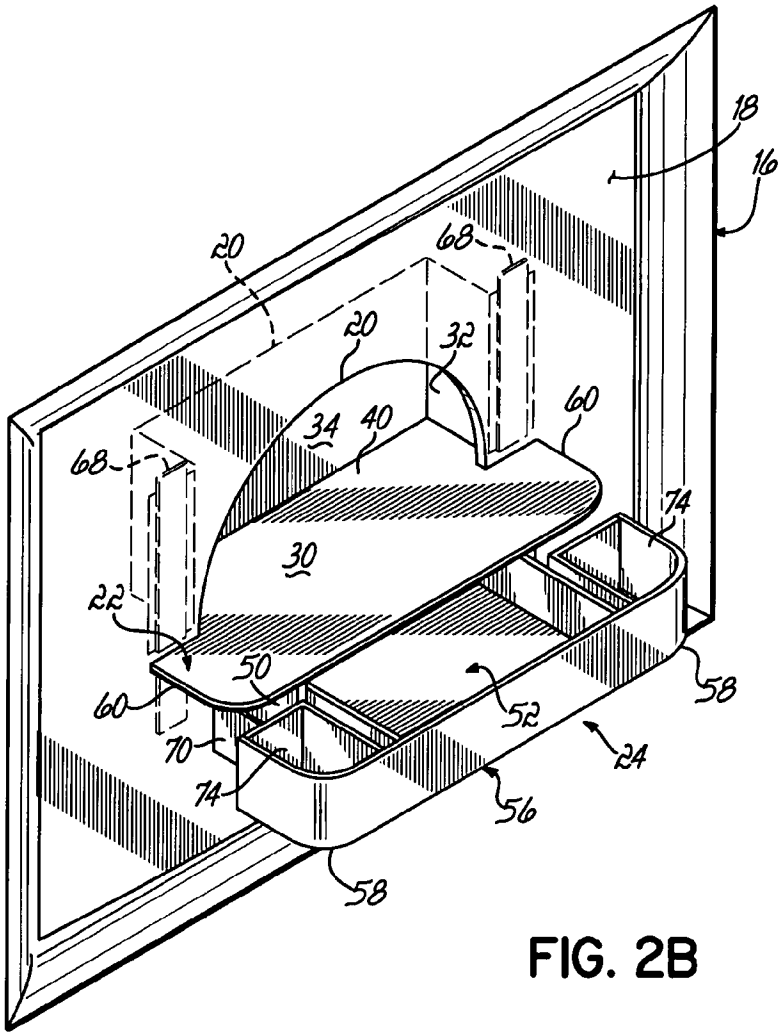
FIG. 2B is a view similar to FIG. 2A but in assembled perspective view.

Referring to FIGS. 2A and 2B, the alcove structure 20 can have a floor 30, a pair of side walls 32, 32, and a back wall 34. Facilitating assembly to the cap panel 18, each side wall 32 can have an outwardly extending flange 36 which can be attached to a rear side of the cap panel 18 with, for example, double sided tape 38. Other suitable forms of attachment can be used. Side walls 32, 32, back wall 34, and flanges 36, 36 can advantageously be made from a single sheet of material having 90° fold lines.

Shelf assembly 22 can include a shelf surface or simply shelf 40 which can be co-planar with the floor 30 of the alcove 20. In fact, shelf 40 can advantageously be made as a part or an extension of floor 30 of alcove structure 20, i.e. as a single sheet of material. The alcove 20 defines an opening 42 in the cap panel 18. Shelf 40 can be wider than the opening 42. An upper end 44 of the opening 42 can be arcuately shaped. The shelf 40 can have forwardly projecting corners 46, 46 which are arcuately shaped.

The drawer assembly 24 can comprise a drawer supporting box structure 50 mounted to the cap panel 18, and a drawer 52 which is movably received in the box structure 50. The shelf 40 can be wider than the box structure 50. The drawer 52 can have a drawer front 56 having forwardly projecting corners 58, 58 which are shaped so as to be matingly arcuately shaped with the arcuately shaped corners 46, 46 of the shelf 40. Box structure 50 can be attached to the lower surface of the sheet of material forming the alcove floor 30 and shelf 40 with, for example, double sided tape (not shown), or with any other suitable form of attachment.

Assembled, the lateral edges 60, 60 of the alcove floor 30 and shelf 40 can fit in slots 62, 62 in the opening 42 in the cap panel, and the lower surface of box structure 50 can rest atop lower end 64 of opening 42. There can be slots 66, 66 near the lateral edges 60, 60 of alcove floor 30 which accept supports 68, 68. The supports 68, 68 can be attached to the rear side of the cap panel 18 with, for example, double sided tape 38. On the front side of the cap panel 18, decorative supports 70, 70 can support the lower surface of the box structure 50. Reinforcement strips 72, 72 can be placed against the rear surface of the cap panel 18, and screws (not shown) can sandwich the cap panel 18 between the reinforcement strips 72, 72 and the supports 70, 70. Due to the manner in which the forward corners 58, 58 of the drawer front 56 can be arcuately shaped so as to match the arcuate shape of the forward corners 46, 46 of the shelf 40, the forward corners 58, 58 can "wrap around" the lateral sides of the box structure 50 when the drawer 52 is in the closed position, thereby forming additional side pockets 74, 74 as a part of the drawer front 56.

Cap panel 18, alcove structure 20, shelf 22, and drawer 24 can advantageously be made from a type of sheet material known as chip board, single cell cardboard or any other suitable material, which can be fabric covered for decorative purposes. Supports 68 and reinforcing strips 72 can be made from any suitable material such as wood, plastic, etc. Supports 70 can be wood, plastic, or other suitable material.

The embodiments shown and described are for illustrative purposes only. The drawings and the description are not intended to limit in any way the scope of the claims. Those skilled in the art will appreciate various changes, modifications, and alternative embodiments. All such changes, modifications and embodiments are deemed to be embraced by the claims. Accordingly, the scope of the right to exclude shall be limited only by the following claims and their equivalents.

What is claimed is:

1. A casket comprising:
a shell,
a cap closable on said shell, and
a dish assembly mounted to an underside of said cap, said dish assembly comprising:
a cap panel,
an alcove structure formed in said cap panel and adapted to receive an ornament for display when said cap is open,
a shelf mounted to said cap panel which projects forwardly and is adapted to support an ornament for display when said cap is open, and
a drawer assembly mounted to said cap panel for display and storage of items of memorialization of a deceased,
wherein said alcove has a floor, a pair of side walls, and a back wall,
wherein said shelf is co-planar with said floor of said alcove.

2. The casket of claim 1 wherein said casket is a full-couch casket having a single full length cap.

3. The casket of claim 1 wherein said casket is a split cap casket having a head end cap and a foot end cap.

4. The casket of claim 1 wherein said alcove defines an opening in said cap panel, and wherein said shelf is wider than said opening.

5. The casket of claim 4 wherein an upper end of said opening is arcuately shaped.

6. The casket of claim 4 wherein said shelf has forwardly projecting corners which are arcuately shaped.

7. The casket of claim 1 wherein said drawer assembly comprises a drawer supporting box structure mounted to said cap panel and a drawer which is movably received in said box structure.

8. The casket of claim 7 wherein said shelf is wider than said box structure.

9. The casket of claim 8 wherein said shelf has forwardly projecting corners which are arcuately shaped, and wherein said drawer has a drawer front having forwardly projecting corners which are matingly arcuately shaped.

10. A casket comprising:
a shell,
a cap closable on said shell, and
a dish assembly mounted to an underside of said cap, said dish assembly comprising:
a cap panel, an alcove structure formed in said cap panel and adapted to receive an ornament for display when said cap is open, and a shelf mounted to said cap panel which projects forwardly and is adapted to support an ornament for display when said cap is open, wherein said alcove has a floor, a pair of side walls, and a back wall, wherein said shelf is co-planar with said floor of said alcove.

11. The casket of claim 10 wherein said casket is a full-couch casket having a single full length cap.

12. The casket of claim 10 wherein said casket is a split cap casket having a head end cap and a foot end cap.

13. The casket of claim 10 wherein said alcove defines an opening in said cap panel, and wherein said shelf is wider than said opening.

14. The casket of claim 13 wherein an upper end of said opening is arcuately shaped.

15. The casket of claim 13 wherein said shelf has forwardly projecting corners which are arcuately shaped.

16. A casket comprising:

a shell, a cap closable on said shell, and a dish assembly mounted to an underside of said cap, said dish assembly comprising:

a cap panel, an alcove structure formed in said cap panel and adapted to receive an ornament for display when said cap is open, and a drawer assembly mounted to said cap panel for display and storage of items of memorialization of a deceased, wherein said alcove has a floor, a pair of side walls, and a back wall, wherein said drawer assembly comprises a drawer supporting box structure mounted to said cap panel and a drawer which is movably received in said box structure.

17. The casket of claim 16 wherein said casket is a full-couch casket having a single full length cap.

18. The casket of claim 16 wherein said casket is a split cap casket having a head end cap and a foot end cap.

19. The casket of claim 16 wherein said drawer has a drawer front having forwardly projecting corners which are arcuately shaped.

20. The casket of claim 16 wherein said alcove defines an opening in said cap panel, and wherein an upper end of said opening is arcuately shaped.

21. A casket comprising:

a shell, a cap closable on said shell, and a dish assembly mounted to an underside of said cap, said dish assembly comprising:

a cap panel, a shelf mounted to said cap panel which projects forwardly and is adapted to support an ornament for display when said cap is open, and a drawer assembly mounted to said cap panel for display and storage of items of memorialization of a deceased, wherein said drawer assembly comprises a drawer supporting box structure mounted to said cap panel and a drawer which is movably received in said box structure.

22. The casket of claim 21 wherein said casket is a full-couch casket having a single full length cap.

23. The casket of claim 21 wherein said casket is a split cap casket having a head end cap and a foot end cap.

24. The casket of claim 21 wherein said shelf has forwardly projecting corners which are arcuately shaped.

25. The casket of claim 21 wherein said shelf is wider than said box structure.

26. The casket of claim 21 wherein said shelf has forwardly projecting corners which are arcuately shaped, and wherein said drawer has a drawer front having forwardly projecting corners which are matingly arcuately shaped.

27. A casket comprising:

a shell, a cap closable on said shell, and a dish assembly mounted to an underside of said cap, said dish assembly comprising:

a cap panel, and a drawer assembly mounted to said cap panel for display and storage of items of memorialization of a deceased, wherein said drawer assembly comprises a drawer supporting box structure mounted to said cap panel and a drawer which is movably received in said box structure.

28. The casket of claim 27 wherein said casket is a full-couch casket having a single full length cap.

29. The casket of claim 27 wherein said casket is a split cap casket having a head end cap and a foot end cap.

30. The casket of claim 27 wherein said drawer has a drawer front having forwardly projecting corners which are arcuately shaped.

31. A casket comprising:

a shell, a cap closable on said shell, and a dish assembly mounted to an underside of said cap, said dish assembly comprising:

a cap panel, an alcove structure formed in said cap panel and adapted to receive an ornament for display when said cap is open, and a drawer assembly mounted to said cap panel for display and storage of items of memorialization of a deceased, wherein said alcove has a floor, a pair of side walls, and a back wall, wherein said drawer assembly comprises a drawer support structure mounted to said cap panel and a drawer which is movably received in said support structure.

32. A casket comprising:

a shell, a cap closable on said shell, and a dish assembly mounted to an underside of said cap, said dish assembly comprising:

a cap panel, a shelf mounted to said cap panel which projects forwardly and is adapted to support an ornament for display when said cap is open, and a drawer assembly mounted to said cap panel for display and storage of items of memorialization of a deceased, wherein said drawer assembly comprises a drawer support structure mounted to said cap panel and a drawer which is movably received in said support structure.

33. A casket comprising:

a shell, a cap closable on said shell, and a dish assembly mounted to an underside of said cap, said dish assembly comprising:

a cap panel, and a drawer assembly mounted to said cap panel for display and storage of items of memorialization of a deceased, wherein said drawer assembly comprises a drawer support structure mounted to said cap panel and a drawer which is movably received in said support structure.

34. A casket comprising:

a shell, a cap closable on said shell, and a dish assembly mounted to an underside of said cap, said dish assembly comprising:

a cap panel, an alcove structure formed in said cap panel and adapted to receive an ornament for display when said cap is open, a shelf mounted to said cap panel which projects forwardly and is adapted to support an ornament for display when said cap is open, and a drawer assembly mounted to said cap panel for display and storage of items of memorialization of a deceased, wherein said drawer assembly comprises a drawer support structure mounted to said cap panel and a drawer which is movably received in said support structure.

* * * * *